United States Patent [19]

Kast et al.

[11] 4,389,919

[45] Jun. 28, 1983

[54] FIRING PIN BLOCK FOR FIREARM WITH A ROTARY BREECH BOLT

[75] Inventors: Jack L. Kast, Ilion; Albert R. Eddy, Frankfort; Merle F. Carter, Mohawk, all of N.Y.

[73] Assignee: Remington Arms Company, Inc., Bridgeport, Conn.

[21] Appl. No.: 374,156

[22] Filed: May 3, 1982

Related U.S. Application Data

[63] Continuation of Ser. No. 121,437, Feb. 14, 1980, abandoned.

[51] Int. Cl.[3] ..... F41D 3/06; F41D 11/16

[52] U.S. Cl. ..... 89/185

[58] Field of Search ..... 42/16, 20, 69 B; 89/166, 172, 185

[56] References Cited

U.S. PATENT DOCUMENTS

| | | | |
|---|---|---|---|
| 2,675,638 | 4/1954 | Crittendon | 42/69 B |
| 2,685,754 | 8/1954 | Crittendon et al. | 42/16 |
| 2,926,446 | 3/1960 | Benson | 42/69 B |
| 2,976,637 | 3/1961 | Robinson | 42/70 R |
| 3,285,133 | 11/1966 | Fowler | 89/185 |
| 3,397,473 | 8/1968 | Browning | 42/25 |
| 3,675,534 | 7/1972 | Beretta | 89/185 |
| 3,690,218 | 9/1972 | Maillard | 89/185 |

FOREIGN PATENT DOCUMENTS 2071928 9/1971 France .

OTHER PUBLICATIONS

Edward C. Ezell, Small Arms of the World, 1977, pp. 560–562.

*Primary Examiner*—Stephen C. Bentley

*Attorney, Agent, or Firm*—Nicholas Skovran; William L. Ericson; Barry Estrin

[57] ABSTRACT

A firing pin block for a firearm of the type having a rotary breech bolt, a reciprocating bolt carrier, complementary locking lugs formed on the bolt and barrel to releasably secure them together, and cam means drivingly connecting the bolt and bolt carrier for opening and closing the bolt. The firing pin block positively prevents discharge of the firearm at any time when the bolt is unlocked. It does not rely on the presence or good condition of any separate parts, but instead coordinates the cam-actuated rotary operation of the locking lugs with relative longitudinal displacements between the bolt and bolt carrier, to cause the latter to block an enlarged abutment formed on the firing pin whenever the bolt is unlocked.

6 Claims, 8 Drawing Figures

FIRING PIN BLOCK FOR FIREARM WITH A ROTARY BREECH BOLT

This application is a continuation of application Ser. No. 121,437, filed Feb. 14, 1980, now abandoned.

FIELD OF THE INVENTION

This invention relates to a firing pin block that prevents a firearm from being discharged with its bolt in an unlocked position. More particularly, it relates to a firing pin block for a firearm of the type in which a breech bolt has locking lugs and is rotatable between a position locked to the barrel and an unlocked position, this rotation being imparted by cam means drivingly connecting the bolt with a reciprocating bolt carrier.

BACKGROUND AND PRIOR ART

The idea of blocking a firing pin to prevent the discharge of a rotary-bolt firearm when the bolt is in an unlocked position is not new. U.S. Pat. No. 2,685,754 to L. R. Crittendon et al., which has a common assignee with the present application, shows such a block; and this invention is an improvement to that device. In the Crittendon Patent, the travel of the firing pin is limited by its retaining pin, which is mounted in the bolt carrier to extend across a flat on the firing pin. Cam means connecting the bolt with the carrier are arranged to rotate and lock the lugs of the bolt to those of the barrel before the carrier completes its forward stroke, allowing some lost motion at the end of this travel. The dimensions are so selected that until the bolt has first been locked and then the lost-motion portion of the carrier stroke has been at least partially completed, the firing pin is restrained by its retaining pin from protruding from the bolt face far enough to fire a cartridge. On firing, the forward momentum of the firing pin is absorbed in part by impact against its retaining pin. This may sooner or later distort the parts enough to interfere with proper operation of the firearm. In an extreme case, distortion may cause the firing pin to jam with its tip protruding from the bolt face. Further, the block is inoperative if the retaining pin is broken or missing.

Another prior-art design of interest is shown by U.S. Pat. No. 3,397,473 to Browning, in which, in common with the present invention, cam means rotate the bolt as a result of sliding motion of the carrier. However, forward motion of the firing pin relative to the bolt is limited only by its engagement with the bolt, or with a retaining pin mounted in the bolt. Therefore, the firing pin is not positively blocked against protrusion from the bolt face when the bolt is unlocked, but is merely biased rearwardly by the firing pin spring.

Prior-art firing pin blocks for bolt-action firearms are shown in U.S. Pat. No. 2,926,446 to Benson, and U.S. Pat. No. 2,976,637 to Robinson. Benson discloses a bolt-action rifle in which a lug on the firing pin is engageable by a cam on the bolt handle; when the handle is raised to unlock the bolt, the cam retracts the firing pin behind the bolt face. Robinson is an example of a hammerless bolt-action rifle in which a firing pin is cocked rearwardly by a cam on the bolt when its handle is raised, and positively held by the cam in this retracted position until the handle is lowered to lock the bolt.

BRIEF DESCRIPTION OF THE INVENTION

It is the general object of the present invention to provide a firing pin block that positively prevents the discharge of a rotary-bolt firearm when its bolt is unlocked, and that will permit firing only after a safe degree of bolt lock-up is achieved. A further object is to insure positive operation of the block even if the firing pin spring and retaining pin have been distorted, have failed, or are missing altogether. Another object is to provide a simple, economical firing pin block for rotary-bolt firearms that does not require any separate parts, in addition to a bolt, bolt carrier, firing pin, and cam means drivingly connecting the bolt and bolt carrier, that can be omitted or lost in assembly.

Although the firing pin block of the present invention can serve as the sole means to prevent firing of a rotary-bolt firearm when the bolt is unlocked, it is preferred to use the system as a fail-safe device, in conjunction with other, conventional means for preventing firing when the bolt is open. For example, the assignee of the present invention has for some years made firearms having a trigger disconnector (which may be integrated with an action bar lock in slide-action models) to prevent firing when the breech bolt is open. Examples of these devices are shown in U.S. Pat. Nos. 2,675,638 and 2,685,754 to L. R. Crittendon.

The present firing pin block incorporates an enlarged head or abutment formed on the firing pin, which is engageable with the rear end of the bolt carrier slide to block the firing pin from any forward protrusion beyond the bolt face until locking lugs formed on the breech bolt are at least partially, and preferably fully, locked into complementary lugs on the barrel or barrel extension. The blocking action is achieved by coordination of the relative longitudinal movements of the bolt carrier and bolt with the operation of cam means which drivingly connect them to produce rotary locking movement of the bolt after it has closed on the barrel breech, and the carrier continues to slide forwardly. The degree of lock-up that must be attained before firing becomes possible can be changed by varying these relationships, although it is highly preferable to delay removing the blockage until after the locking lugs are fully engaged and the bolt is completely locked.

The improved firing pin block has an additional advantage in that it mechanically retracts the firing pin to a position behind the bolt face as the bolt is opened after firing. The firing pin is thus retracted to a safe position even if the firing pin spring or retaining pin are broken, distorted, or missing.

DETAILED DESCRIPTION

The present invention is equally applicable to manual slide-operated firearms and gas-operated semiautomatic firearms of the type having a rotary bolt. Since the fire control system and the reloading system of the firearm are not directly concerned with the firing pin block of this invention, and may be of various designs well known in the art, these systems have been omitted from the drawings. Reference is made to the aforementioned U.S. Pat. Nos. 2,685,754 and 2,675,638 for typical examples of firearms to which the present invention might be applied.

Figure 1:
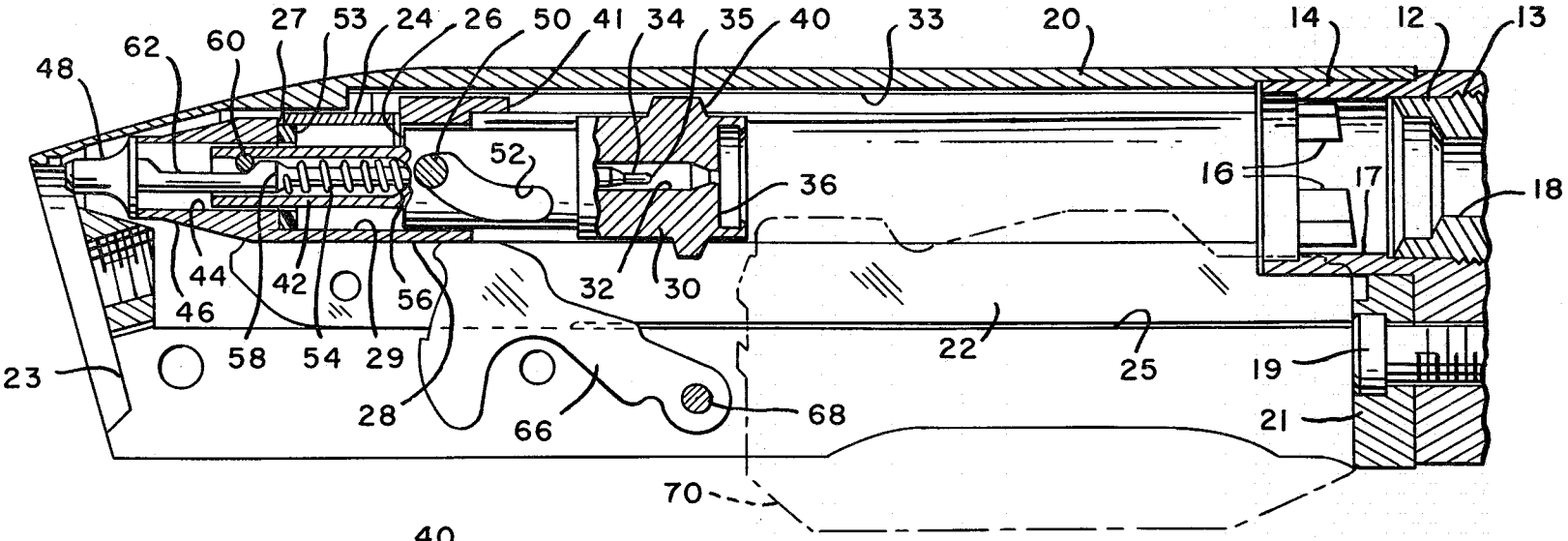
FIG. 1 is a fragmentary sectional view in side elevation of a firearm incorporating a preferred embodiment of the invention, showing the rotary bolt and a bolt carrier slide at the rear ends of their strokes, and the breech open.
Figure 2:
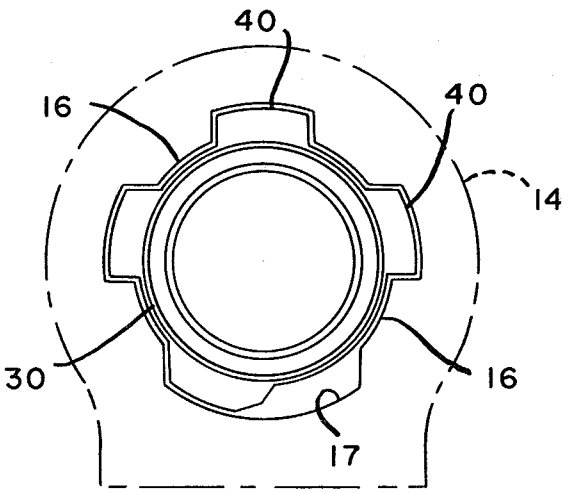
FIG. 2 is a diagrammatic end view showing the angular relationship between complementary locking lugs formed on the bolt and the barrel, in the open-bolt position of FIG. 1.

FIGS. 1 and 2 show a firearm having a barrel 12 formed with a cartridge-receiving chamber 18. A barrel extension 14 is threaded on the barrel at 13, and is formed with a series of conventional circumferentially-spaced locking lugs 16. The barrel extension is attached by a bolt 19 to a forward portion 21 of a receiver 20, which has a socket 23 at its rear end for mounting a shoulder stock (not shown). An action bar assembly 22 is reciprocably slidable in the receiver, and extends forwardly for attachment to conventional manual or gas operating means (not shown) located at the fore-end of the firearm. The action bars 22 are interconnected at their rear ends by an integral U-shaped yoke 24, which fits into a recess 27 in a bolt carrier slide 28 to provide a fixed connection therewith. A resilient plastic ring 53 maintains correct lateral alignment between the yoke 24 and slide 28.

A breech bolt 30 is slidably and rotatably received in a bore 29 in the bolt carrier 28. The bolt has an axial bore 32, in which a firing pin 34 is reciprocably slidable between a retracted position shown in FIG. 1, in which its tip 35 is withdrawn behind the bolt face 36, and an extended position in which the tip protrudes from the bolt face, as shown at 35" in FIG. 6, to fire a cartridge (not shown) received in the chamber 18. The firing pin is biased rearwardly by a compression spring 54 received in the bore 32 and bearing against shoulders 56 and 58, respectively formed in the bolt and on the firing pin. The firing pin is secured by a retaining pin 60, extending transversely through a cylindrical shank portion 42 at the rear of the bolt, and cooperating with a flat 62 milled on the firing pin to limit rearward movement of the firing pin relative to the bolt. Forward movement of the firing pin relative to the bolt is limited by engagement of the shank 42 with an enlarged circular head or abutment 48 formed on the firing pin. (See FIG. 7). The distance that the firing pin tip 35 protrudes from the bolt face 36 is critical to proper functioning of the firearm. Control of this dimension in the manufacture of the improved firearm is greatly facilitated by the fact that the engaging surfaces of the shank 42 and abutment 48 are flat, and parallel to the bolt face 36.

The bolt 30 is formed on its exterior cylindrical surface with a pair of similarly-shaped circumferentially-spaced cam slots 52, of which only one appears in the drawings. These cam slots cooperate with a pair of cam pins 50 secured in the bolt carrier 28 to produce rotation of the bolt when it is moved axially relative to the bolt carrier. One of these cam pins may comprise the inner end of a manual bolt-operating handle (not shown), if desired.

Figure 3:
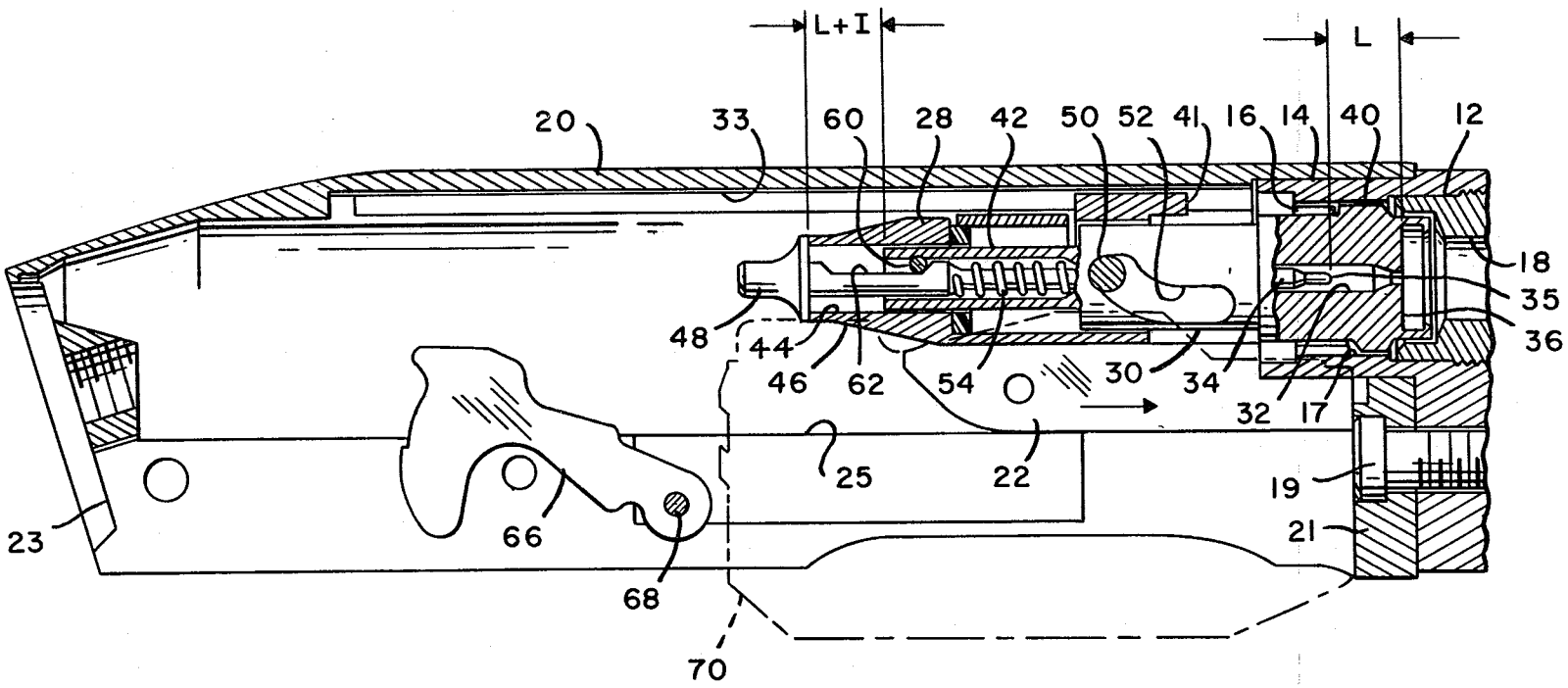
FIG. 3 is a view similar to FIG. 1, but showing the firearm with the bolt carrier approaching the forward end of its stroke, and the bolt closed on the barrel breech but not yet rotated relative to the bolt carrier, so that no rotation of the locking lugs has taken place.

In the positions of the bolt carrier shown in FIGS. 1 and 3, the bolt is rotated to an unlocked position, in which it protrudes forwardly from the bolt carrier, by movement of the cam pins 50 to the rear ends of the slots 52. The bolt has a series of circumferentially-spaced locking lugs 40 around its outer surface; as shown in FIG. 2, these lugs are aligned to enter freely between the lugs 16 of the barrel extension 14 as the bolt is moved forwardly by the action bars 22 and bolt carrier 28 between the positions of FIGS. 1 and 3. This angular alignment is maintained during this forward movement by a rectilinear channel 33 formed in the top of the receiver 20, and extending parallel to the longitudinal axis of the bolt, for receiving and guiding one of the lugs 40. The carrier 28, which is guided for rectilinear reciprocation primarily by the action bars 22 riding on rails 25 formed in the side walls of the receiver 20, also has a guide lug 41 that is slidably received in the channel 33.

The rearwardly-extending tubular shank portion 42 of the bolt 30 is slidably received in a bore 44 formed in a rearward extension 46 of the carrier 28. The enlarged head or abutment 48 engages the carrier extension 46 to prevent forward movement of the firing pin 34, in the relative positions of the parts shown in FIGS. 1 and 3.

The bolt 30 is shown in FIG. 1 protruding forwardly from the carrier 28 to the maximum extent, as defined by engagement of the cam pins 50 with the rear ends of the cam tracks 52. This protruding relationship is maintained, as the carrier moves the bolt forwardly, by the lug 40 sliding in the channel 33. The maximum retraction of the bolt into the carrier, as shown in FIG. 7, is defined by the cam pins 50 engaging the forward ends of the cam tracks 52, after these cam means have rotated the bolt to its locked position.

Figure 7:
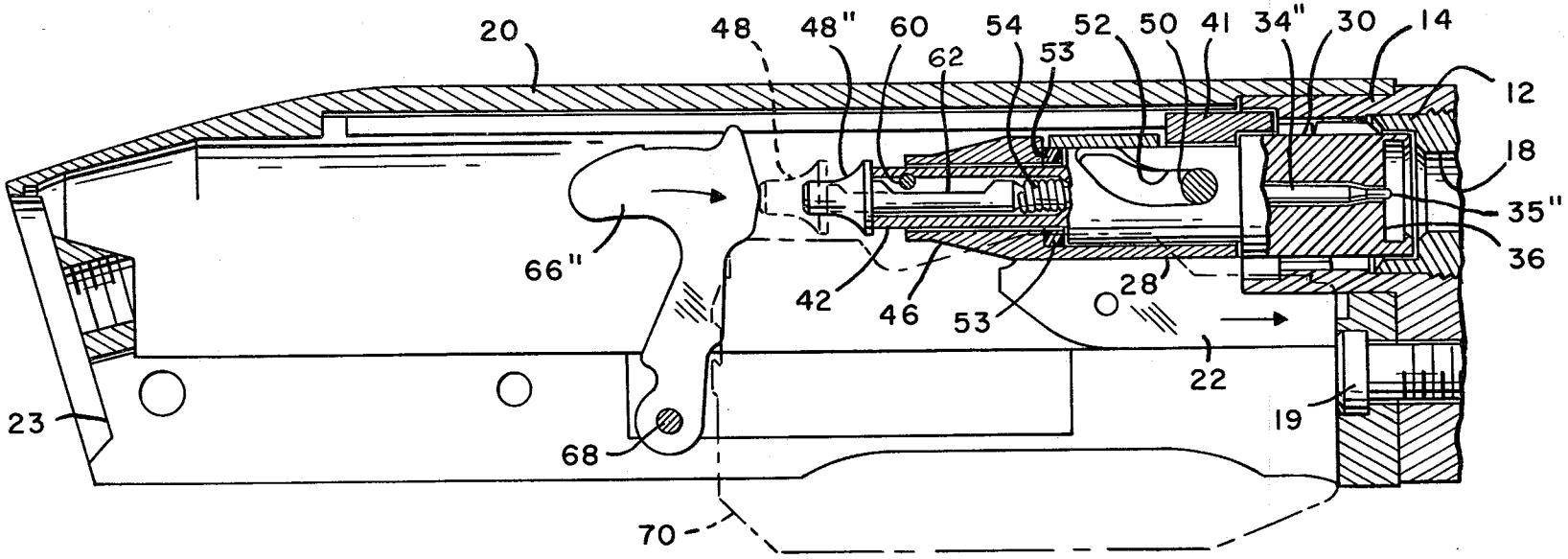
FIG. 7 is a view similar to FIG. 6, but showing the completion of the forward stroke of the bolt carrier, with the parts in their normal firing positions, and the hammer shown striking the firing pin.

A hammer 66 is pivotally mounted on a pin 68 secured in the receiver 20, and is rotatable clockwise, when released by a suitable trigger and fire control mechanism (not shown) from a cocked position shown in FIG. 1 to a firing position shown in FIG. 7, in which it impacts the rear end of the firing pin to discharge the firearm. A box magazine 70 is mounted in the receiver in a conventional fashion to supply a series of cartridges, each of which is fed successively into the chamber 18 by a forward movement of the bolt 30. In the illustrated embodiment, the clockwise rotation of the hammer 66 is limited by its engagement with the magazine 70, as shown in FIG. 7, and the firing pin is driven forwardly by the momentum of hammer impact imparted to it prior to this engagement.

CYCLE OF OPERATION

Referring now to FIG. 3, the bolt carrier 28 and action bars 22 are shown moving forward, in the direction shown by the arrow. The bolt has passed over the magazine 70, where it could have picked up a cartridge (not shown), and its forward stroke has been terminated by abutment against the barrel 12, in which position it would have seated the cartridge in the chamber 18. The bolt lugs 40 have passed freely between the barrel lugs 16, have left the receiver channel 33, and have entered a cylindrical recess 17 in the barrel extension 14, so that the bolt is now free to rotate. However, no bolt rotation has yet occurred, since the cam pins 50 have not yet been moved by the forward travel of the bolt carrier 28 from the rear ends of the cam tracks 52.

It will be observed in FIG. 3 that a premature release of the hammer 66, which is possible at this point, will merely impact the head 48 of the firing pin against the rearward extension 46 of the bolt carrier, since these parts still remain in contact. Thus the firing pin is blocked and cannot be moved forwardly in the bolt bore 32 at this time, either by impact of the hammer 66, or by its own inertia if the firearm is accidentally dropped, even if the spring 54 should be distorted, broken, or missing.

Figure 4:
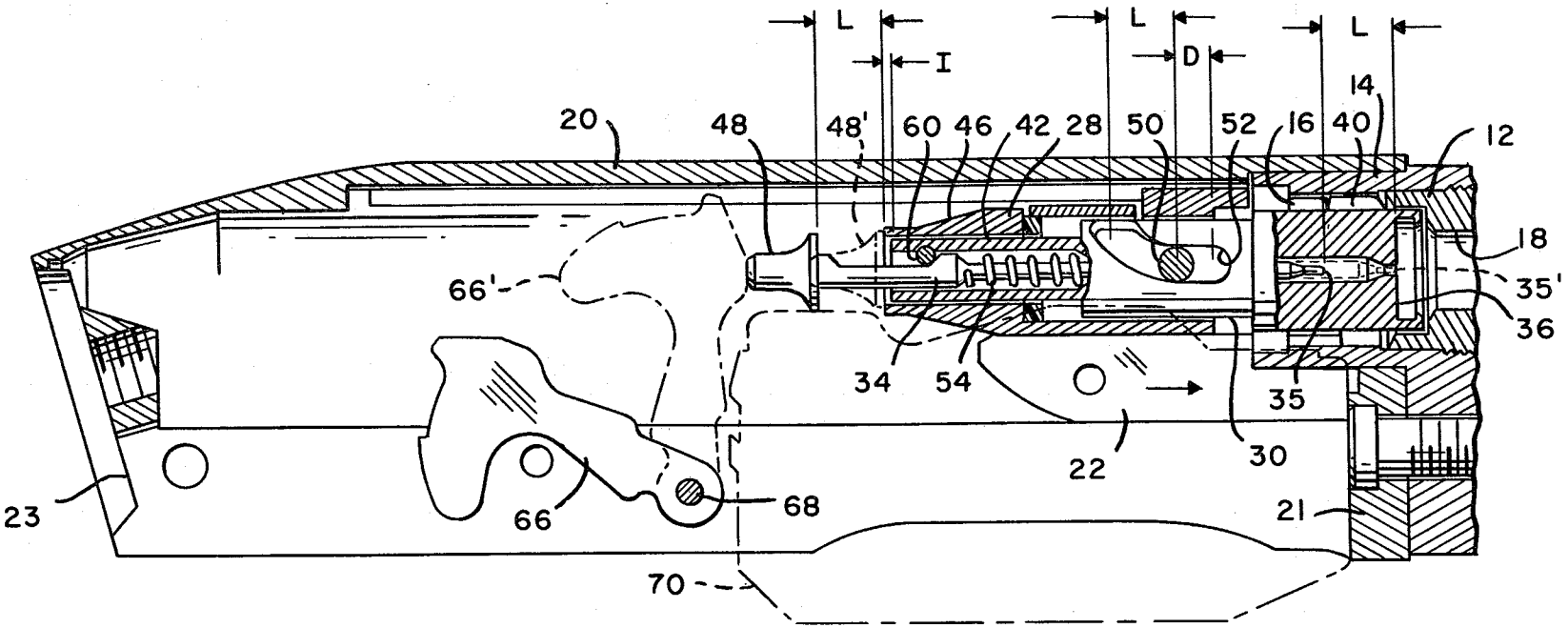
FIG. 4 is a view similar to FIG. 3, but showing the firearm with the bolt carrier moved farther forward relative to the bolt, enough to cause rotation of the locking lugs to bring the bolt into fully locked-up relation to the barrel, but not yet far enough to permit firing to occur.
Figure 5:
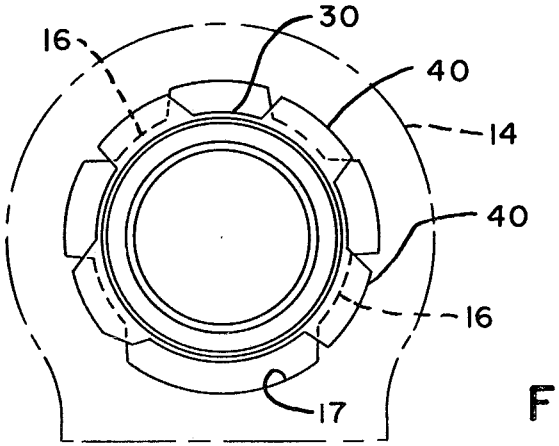
FIG. 5 is a diagrammatic end view showing the angular relationship between the locking lugs of the bolt and barrel in the locked position of FIG. 4.

As shown in FIG. 4, the action bars 22 have carried the bolt carrier 28 far enough forward relative to the bolt 30, which can travel no farther, to cause the pins 50 to traverse the curved portions and enter into the longitudinal portions of the cam slots 52, and at the same time to move forward a distance L relative to the bolt. This distance is slightly more than sufficient to rotate the bolt and engage the bolt lugs 40 behind the barrel lugs 16, as shown in FIG. 5, to lock the bolt to the barrel extension 14.

The firing pin 34, being pressed rearwardly by its spring 54 against the retaining pin 60 in the bolt, begins to protrude rearwardly from the carrier extension 46 at the same time as the carrier 28 commences to move forward from the FIG. 3 position toward that of FIG. 4. The carrier 28 consequently reaches a position in FIG. 4 such that the gap between the head 48 of the firing pin and the carrier extension 46 is equal to L, the same distance that the cam pins 50 have moved forwardly in the bolt 30. The parts are so dimensioned that the distance between the tip 35 of the firing pin and the bolt face 36 is also equal to L.

If the trigger is pulled at the stage shown in FIG. 4, releasing the hammer 66 to strike the firing pin at a position 66', it will be seen that the head of the firing pin can travel forwardly only the distance L before it is stopped at a position 48', abutting against the carrier extension 46. Therefore the firing pin tip will be halted at a position 35' flush with the bolt face 36, so that it cannot discharge a cartridge in the chamber. It would be necessary for the firing pin to travel an additional distance forward before the tip 35 could protrude far enough from the bolt face to indent and ignite the primer of a cartridge. Thus, even though the bolt has reached a fully-locked condition at the stage shown in FIG. 4, still further forward travel of the bolt carrier is required before the firearm can be discharged; this provides an additional margin of safety to cover the possibility that the parts might become distorted or badly worn.

Figure 6:
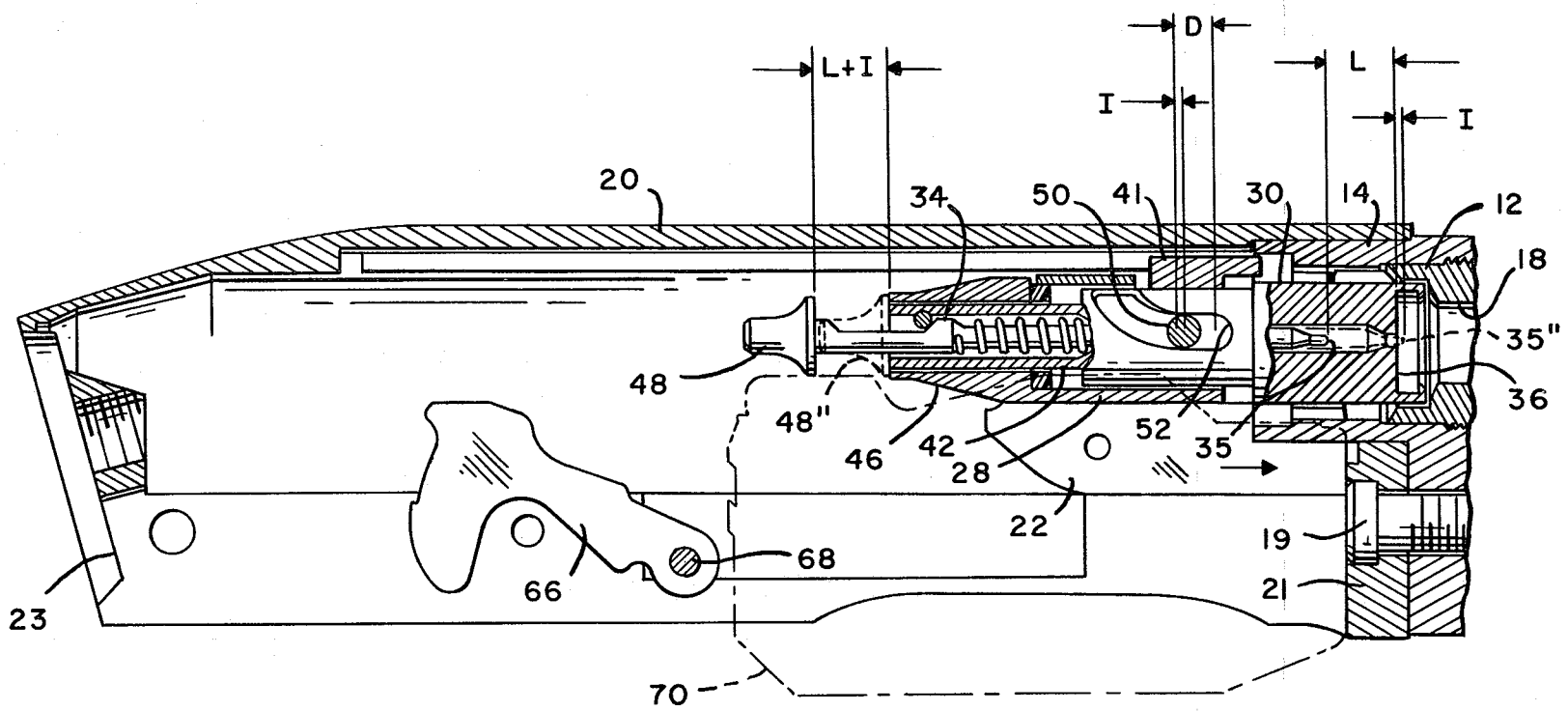
FIG. 6 is a view similar to FIG. 4, but showing the bolt carrier moved still farther forward, to the first position in which firing becomes possible.

In the position of FIG. 4, the carrier extension lies a distance I behind the bolt shank 42. Additional forward movement of the carrier 28 through the distance I is illustrated in FIG. 6. If the hammer is released at this stage, it will drive the firing pin forward the distance L+I, causing the head to reach a position 48'' abutting against the bolt shank 42, and the tip to reach a position 35'' protruding the distance I beyond the bolt face 36. This is the maximum depth to which a cartridge primer can be indented by the forward momentum of the firing pin.

The cam tracks 52 have straight lost-motion sections extending forwardly from their curved sections a dwell distance D, as appears in FIGS. 4 and 6, to allow not only the incremental forward movement I of the carrier 28 and action bars 22, but also some additional movement into their extreme forward positions shown in FIG. 7. At any point in this additional movement, the weapon may be fired by releasing the hammer, which strikes the head of the firing pin as it reaches a position 66'', in which it is halted by contact with the magazine 70. The momentum imparted to the firing pin 34 compresses the spring 54, and drives the firing pin forwardly until its head strikes the bolt shank 42 at the position 48'', and its tip projects from the bolt face at the position 35'' to discharge the firearm.

Figure 8:
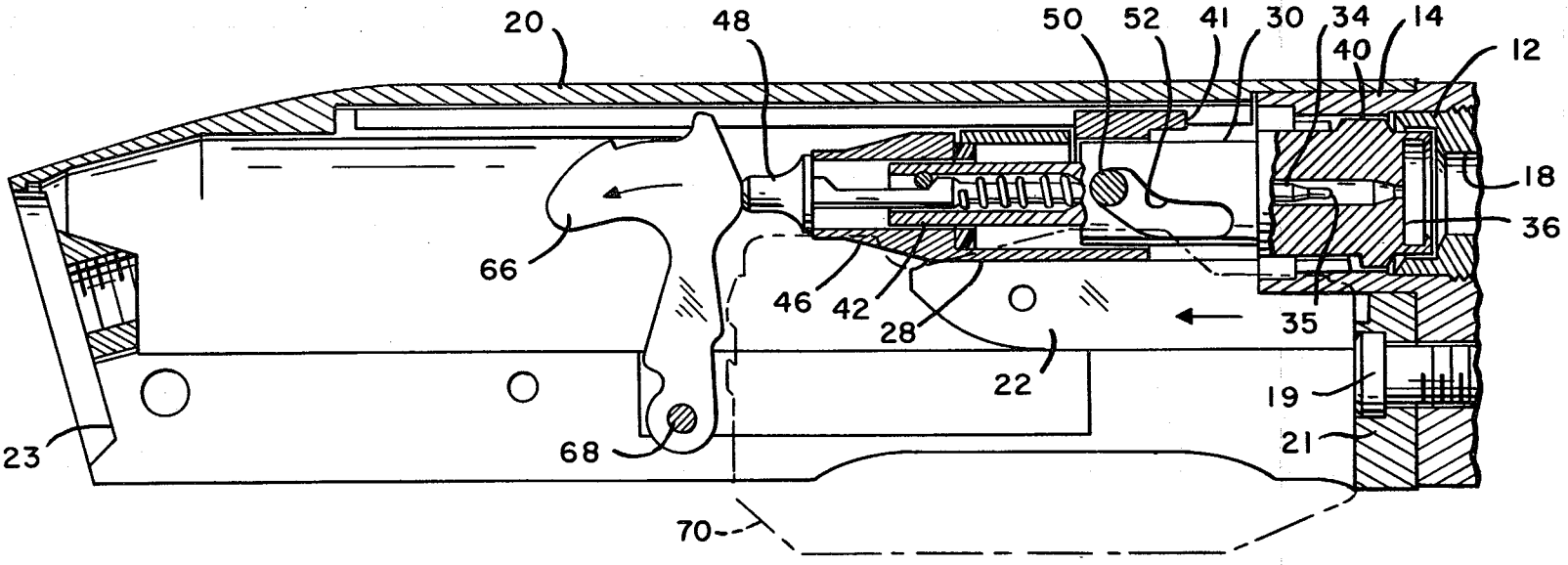
FIG. 8 is a view similar to FIG. 7, but showing the commencement of rearward movement of the bolt carrier after firing, to unlock and open the bolt and re-cock the hammer.

FIG. 8 illustrates the initiation of subsequent movements of the parts to reopen the breech and recock the hammer. The action bars 22 are driven to the rear, as shown by the arrow, by either manual or gas operation as the case may be. This initially retracts only the bolt carrier 28, as its attached cam pins 50 pass through the straight lost-motion portions of the cam slots 52. Then the cam pins pass into the curved portions of the cam slots, rotating the bolt 30 to the unlocked position of FIG. 2. At the illustrated stage, with the cams pins 50 at the rear ends of the slots 52, the rearward movement of the action bars and bolt carrier is imparted to the bolt 30 as well.

During the rearward travel of the bolt carrier 28, its extension 46 pulls the firing pin head 48 along with it, away from contact with the bolt shank 42. The head 48 soon engages the hammer 66, and pushes it counterclockwise out of contact with the magazine 70. The completion of the counterclockwise hammer recocking motion is effected by a subsequent engagement between the bottom of the bolt carrier and the hammer, until the parts reach the position of FIG. 1, when the hammer is held cocked by the aforementioned fire control.

VARIATION OF DIMENSIONAL RELATIONSHIPS

In the preferred embodiment which has been illustrated and described, the rearward extension 46 of the bolt carrier 28 is made even longer than is necessary to ensure that the bolt lugs 40 must be fully locked to the barrel lugs 16 before the firing pin tip 35 can be made to protrude from the bolt face 36 to discharge the weapon. This provides a margin of extra safety in the event that the parts, particularly the enlarged firing pin head or abutment 48 and the extension 46, might become worn or distorted. This aspect of the invention can be more clearly understood by analyzing the dimensional relationships of the parts in somewhat greater detail.

As appears in FIGS. 6 and 7, the length of the firing pin 34, between the forward surface of the abutment 48 and the tip 35, is equal to the length of the bolt 30 plus the maximum cartridge indent distance I, which is reached by the tip upon contact of the abutment with the bolt shank 42. The extension 46 is of such a length that after the bolt carrier has moved forwardly from the position of FIG. 1 to that of FIG. 3 to close the bolt against the breech of the barrel 12, it holds the abutment 48 at a distance L+I to the rear of the bolt shank 42, and consequently holds the firing pin tip at a distance L to the rear of the bolt face 36.

Movement of the bolt carrier farther forward a distance L, to the position of FIG. 4, causes the cam pins 50 to pass through the curved portions of the cam tracks 52, whose longitudinal length defines the distance L, and rotates the bolt to lock it to the barrel. At this stage, the carrier extension 46 still lies to the rear of the shank 42 a distance I, so that the abutment 48 can travel forwardly no more than the distance L, only enough to bring the tip 35 flush with the bolt face. Still further forward travel of the bolt carrier through the distance I, to the position of FIG. 6, is necessary to remove the block against contact between the abutment 48 and the shank 42.

It will be seen from this analysis that if the extension 46 were to be shortened by the length I, the full bolt lock-up condition shown in FIG. 4 would still have to be achieved before the abutment 48 could contact the shank 42 and cause the tip 35 to protrude the distance I. If the extension 46 were to be shortened still more, this protrusion of the firing pin could be permitted at some point during the locking rotation of the bolt 30, when the lugs 40 and 16 were sufficiently engaged to insure safety, but not fully interlocked as shown in FIGS. 4 and 5. Such variations are considered to fall within the scope of the invention in its broader aspects, although they are not preferred because of the lesser degree of safety they would provide in a firearm that is intended to serve a useful life of indefinite length, and whose parts might become worn or distorted after long use.

What we claim is:

1. A firearm having a receiver, and a barrel secured to said receiver and having a rearwardly-open breech formed with locking lugs;

a bolt carrier reciprocable in said receiver along a longitudinal axis but restrained against rotation thereabout, said bolt carrier having a rearward extension;

a breech bolt having a front face adapted to close said breech, being formed with locking lugs engageable by rotation of said bolt to lock said bolt to said breech lugs, and being reciprocable and rotatable in said bolt carrier with respect to said axis;

a firing pin having a flat formed thereon, and received in said bolt for sliding movement along said axis between a position retracted behind said face and a position protruding therefrom, and having an enlarged abutment formed rearwardly thereon, said abutment being aligned with said rearward extension of said bolt carrier along said axis so that the extreme forward displacement of said firing pin with respect to said bolt carrier is limited by direct engagement of said abutment with said rearward extension;

cam means drivingly connecting said bolt with said bolt carrier, said cam means comprising a cam slot in said bolt and a cooperating cam pin secured to said bolt carrier and slidable in said cam slot; said cam slot having a curved rear section extending along said axis and through an angle thereabout, and having a longitudinal forward section extending substantially parallel to said axis;

said cam means being constructed and arranged: for effecting a forward longitudinal movement of said bolt to close said face against said breech, in response to an initial forward movement of said bolt carrier; for effecting movement of said cam pin through said curved rear cam section to rotate said bolt and said lugs into locking engagement with said breech, in response to a further forward movement of said bolt carrier; and for allowing movement of said cam pin through said longitudinal forward cam section while restraining said bolt against rotation with respect to said breech, in response to a continued forward movement of said bolt carrier;

said rearward extension of said bolt carrier extending rearwardly to a length sufficient to block said firing pin against displacement into said protruding position during movement of said cam pin throughout said rear cam section, and to be displaced forwardly to a position enabling said firing pin to be moved into said protruding position only after entry of said cam pin into said longitudinal forward section of said cam slot;

and a retaining pin received in said flat for free sliding movement of said firing pin along said axis within limits defined by the length of said flat, said retaining pin being secured in said bolt whereby, upon completion of said forward longitudinal movement of said bolt against said breech, forward movement of said firing pin from said retracted position is restricted solely by said rearward extension of said bolt carrier.

2. A firearm as recited in claim 1, said curved rear section of said cam slot extending along said axis a fixed distance L, such that rotary movement of said bolt to a fully locked position is completed by said further forward movement of said bolt carrier through said distance L;

said firing pin having a forward tip spaced at least said distance L behind said bolt face in said retracted position thereof;

said rearward extension of said bolt carrier terminating forwardly of said enlarged abutment a distance no greater than L at the conclusion of said further forward movement through said distance L.

3. A firearm as recited in claim 2, said rearward extension of said bolt carrier extending rearwardly to a length such that: upon completion of said initial forward movement of said bolt carrier to close said bolt face against said breech, said rearward extension directly engages said enlarged abutment to restrain said firing pin in said retracted position against forward movement; and upon completion of said further forward movement of said bolt carrier through said distance L, said rearward extension terminates forwardly of said abutment said distance L, whereby said extension limits forward movement of said abutment and said firing pin to distances less than L until said further forward movement of said bolt carrier is fully completed and said cam pin enters said longitudinal forward section of said cam slot.

4. A firearm as recited in claim 2, in which said bolt has a rear shank portion engaged by said enlarged abutment in said protruding position of said firing pin; said rearward extension of said bolt carrier being positioned at the completion of said initial forward movement of said bolt carrier at a distance to the rear of said shank portion at least as great as said distance L.

5. A firearm as recited in claim 4, said rearward extension of said bolt carrier being positioned at the completion of said initial forward movement of said bolt carrier at a distance to the rear of said shank portion exceeding said distance L by a distance I; said rearward extension being moved forwardly by said further forward movement of said bolt carrier through said distance L and thereby extending, at the completion of said further forward movement, said distance I to the rear of said shank portion to prevent engagement of said abutment with said shank portion;

whereby said bolt must first be fully locked, and said continued forward movement of said bolt carrier through said distance I must then be executed to move said rearward extension farther forward through said distance I, before said abutment can contact said shank portion and said firing pin can thereby reach said protruding position.

6. A firing pin block as recited in claim 1, in which said bolt has a rear shank portion against which said firing pin abutment engages in said protruding position of said firing pin; said rearward extension of said bolt carrier being of a length to directly engage and thereby block movement of said firing pin abutment into engagement with said rear shank portion, and thus prevent said firing pin from moving into said protruding position, during movement of said cam pin throughout said curved rear cam section.

* * * * *